US006145714A

United States Patent [19]

Flavin

[11] Patent Number: 6,145,714

[45] Date of Patent: Nov. 14, 2000

[54] THREADING NEEDLE

[76] Inventor: James M. Flavin, P.O. Box 2247, LaGrange, Ga. 30241

[21] Appl. No.: 09/378,112

[22] Filed: Aug. 20, 1999

[51] Int. Cl.[7] ..... A41D 1/04

[52] U.S. Cl. ..... 223/102; 606/222

[58] Field of Search ..... 223/99, 102; 606/222, 606/223; 112/222, 224

[56] References Cited

U.S. PATENT DOCUMENTS

| | | | |
|---|---|---|---|
| 212,534 | 2/1879 | Berry | 112/222 |
| 500,556 | 7/1893 | Blanchard | 112/222 |
| 2,878,979 | 3/1959 | Lippard | 223/102 |
| 2,991,809 | 7/1961 | Hughes | 223/102 |
| 3,168,228 | 2/1965 | Lewis | 223/102 |
| 4,102,478 | 7/1978 | Samoilov | 223/99 |
| 4,667,860 | 5/1987 | Feuerman | 223/99 |
| 5,129,558 | 7/1992 | Feuerman | 223/102 |
| 5,588,568 | 12/1996 | Flavin et al. | 223/99 |

FOREIGN PATENT DOCUMENTS

| | | | |
|---|---|---|---|
| 409358 | 1/1991 | European Pat. Off. | 223/102 |

*Primary Examiner*—Bibhu Mohanty
*Attorney, Agent, or Firm*—Peter Loffler

[57] ABSTRACT

A threading needle threads the eye of the needle with relative ease and has the threader as an integral part of the device. The threading needle has a relatively rigid needle post and a relatively flexible eye that is attached to the needle post proximate the post's pointed end. The eye is bent sidewardly to form a gap between the needle post and the eye in order to allow a thread to be positioned therebetween. The eye is then bent to the other side causing the needle post to push the thread through the eye. The eye is returned to its normal position and the device is ready for use.

9 Claims, 3 Drawing Sheets

THREADING NEEDLE

BACKGROUND OF THE INVENTION

1. Field of the Invention

The present invention relates to a threader for threading a sewing needle wherein the threader forms an integral part of the needle.

2. Background of the Prior Art

Every sewer understands the frustration of trying to thread the eye of a typical sewing needle. The thread refuses to go into the eye even after multiple attempts, which leaves the sewer frustrated and may cause the sewer to postpone the sewing job at hand. Sewers who have arthritis of the hands or other adverse conditions of the hands find the situation even more exasperating.

In order to help the hapless sewer, many needle threading devices have been proposed. Such devices are designed to give the sewer an aid in the threading process. However, many devices are unduly difficult to use and are even more frustrating than the original threading process. Some devices offer little or no help to a sewer who has limited use of her hands due to a medical condition.

Therefore, there is a need in the art for a needle threader that makes the needle threading process simple and straightforward. Such a device must be easy to use and must be utilizable by most individuals even those who have medical conditions associated with their hands. Ideally, such a device will be of simple design and construction.

SUMMARY OF THE INVENTION

The threading needle of the present inventions addresses the aforementioned concerns in the needle threading art. The threading needle is a device that quickly and easily threads a needle and can be used by most individuals. The threading needle is of simple design and construction.

The threading needle of the present invention is comprised of a needle post that has a pointed first end and a second end, and is relatively rigid. An eye, which is a closed loop member, has a third end that is attached to the needle post proximate the first end and a fourth end that terminates beyond the second end of the post, and is relatively flexible. In order to thread the eye, the eye is pulled to one side of the needle post and a is thread positioned in the gap thereformed. The eye is then pulled to the opposite side of the needle post with the needle post pushing the thread through the eye. The thread is pulled by the user through the eye to a desired length and the eye is returned to its normal state of being generally flush with the needle post and the threading needle is ready for use.

BRIEF DESCRIPTION OF THE DRAWINGS

Similar reference numerals refer to similar parts throughout the several views of the drawings.

DESCRIPTION OF THE PREFERRED EMBODIMENT

Figure 1A:
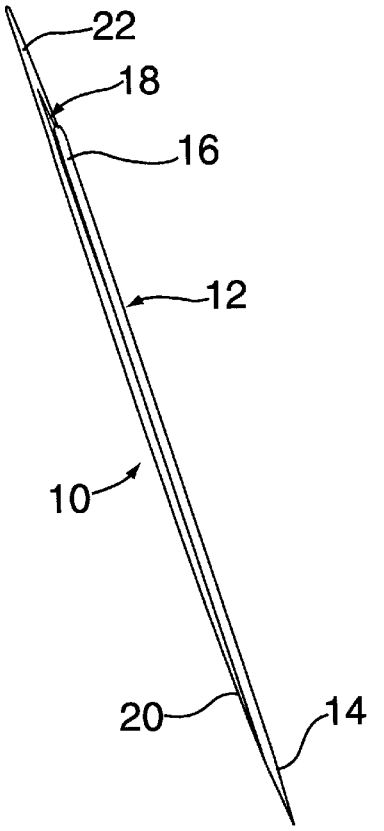
FIG. 1*a* is a perspective view of the threading needle of the present invention.
Figure 1B:
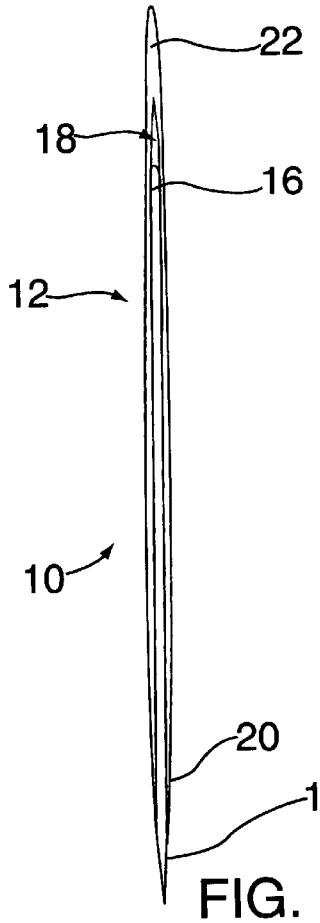
FIG. 1*b* is a front elevation view of the threading needle.
Figure 2A:
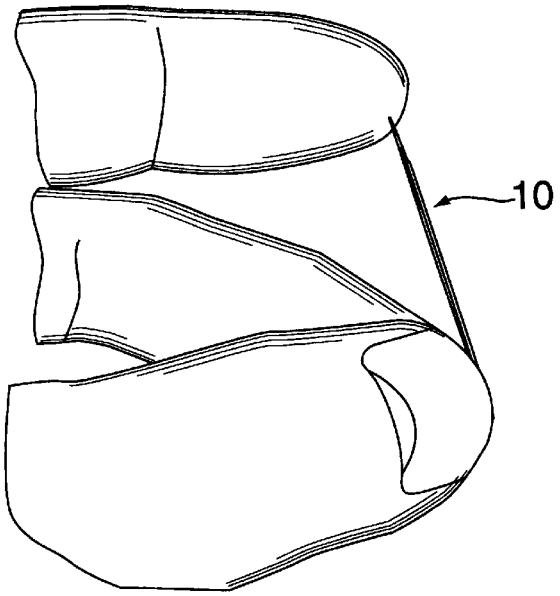
FIG. 2*a* illustrates a user holding the threading needle in a threadless state.
Figure 2B:
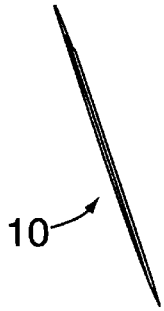
FIG. 2*b* is a perspective view of the threading needle of FIG. 2*a*.
Figure 3A:
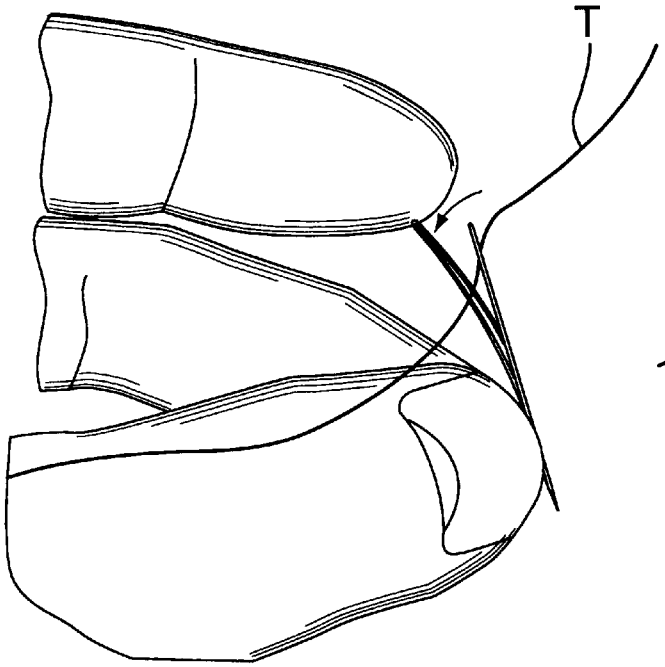
FIG. 3*a* illustrates a user holding the threading needle during the initial thread loading state.
Figure 3B:
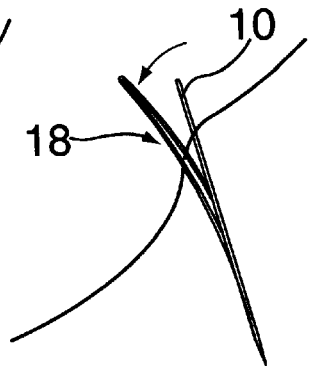
FIG. 3*b* is a perspective view of the threading needle of FIG. 3*a*.
Figure 4A:
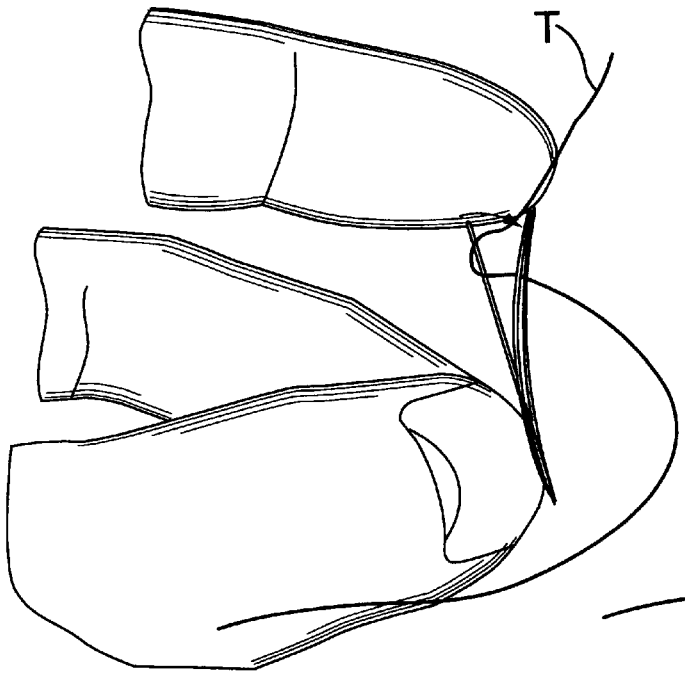
FIG. 4*a* illustrates a user holding the threading needle during the subsequent thread loading state.
Figure 4B:
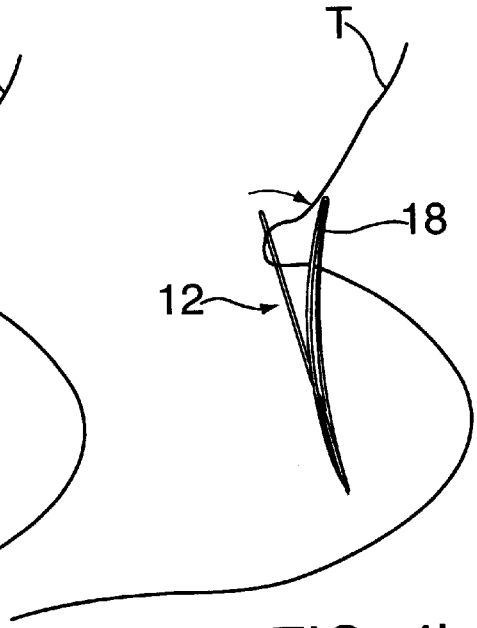
FIG. 4*b* is a perspective view of the threading needle of FIG. 4*a*.
Figure 5:
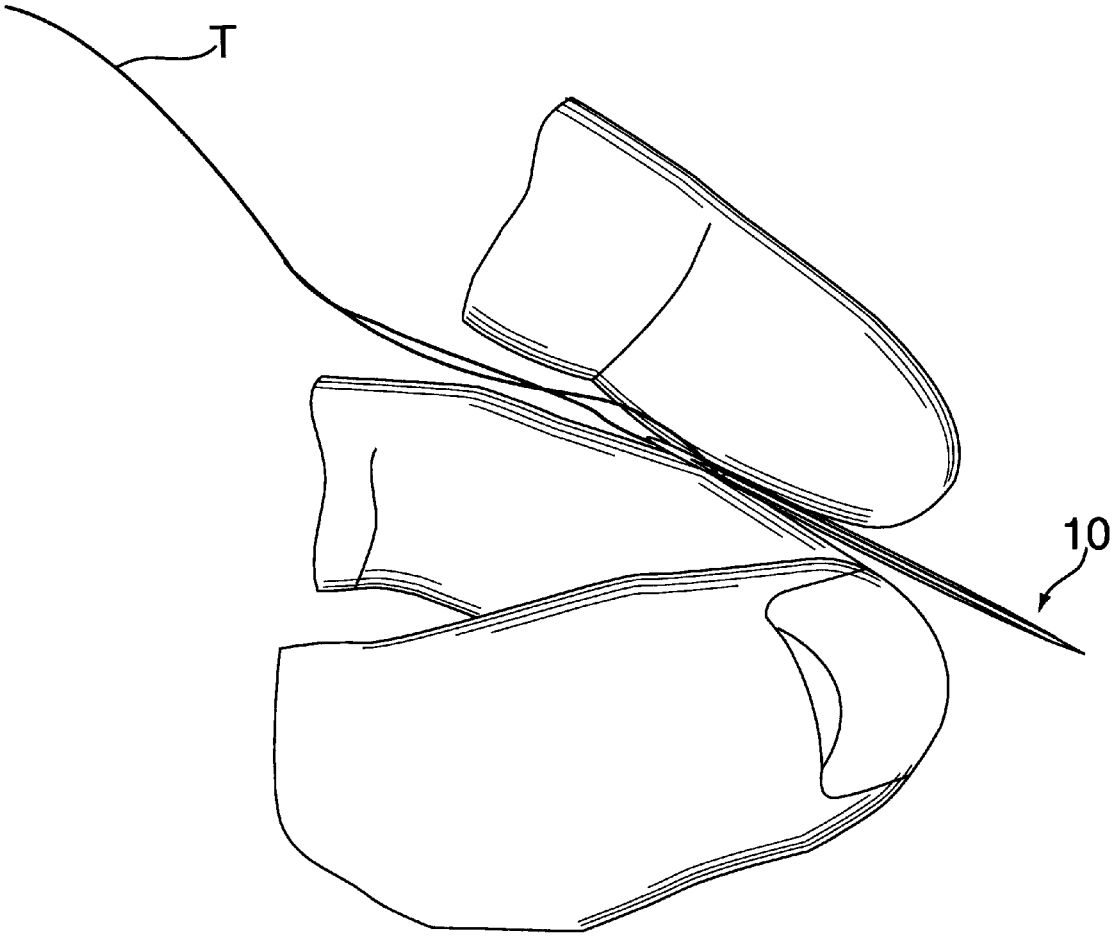
FIG. 5 illustrates a user holding the threading needle in a ready to use state.

Referring now to the drawings, it is seen that the threading needle of the present invention, generally denoted by reference numeral 10, is comprised of a needle post 12 that has a first end 14 that is pointed, and a second end 16 that is not necessarily pointed. The needle post 12 is made from an appropriate rigid material such as that used to make a standard sewing needle. An eye 18 is a resiliently deformable closed loop member that has a third end 20 that is attached to the needle post 12 proximate the first end 14, and a fourth end 22. The eye 18 is made from a relatively flexible material, such as wire, plastic, etc., and has a length that is longer than the length of the needle post 12 so that the fourth end 22 of the eye 18 extends beyond the second end 16 of the needle post 12. Advantageously, the cross-section of the eye 18 is less than the cross-section of the needle post 12. The eye 18 is attached to the post 12 in any desired fashion such as by use of an adhesive or solder.

In order to thread a thread T through the eye 18 of the threading needle 10, the user grasps the threading needle 10 and pulls the eye 18 to one side. The thread T is placed in the gap between the needle post 12 and the eye 18. Thereafter, the eye 18 is pushed to the opposite side of the needle post 12 thereby pushing the thread T through the eye 18. The user pulls the thread T through the eye 18 to a desired length and the eye 18 is returned to its original state of being generally flush with the needle post 12. The threading needle 10 is now threaded and ready for use. As the eye 18 is relatively thin, it forms part of the needle proper of the threading needle 10 and does not impede the sewing process. The point formed by the first end 14 of the needle post 12 and the eye 18 is sufficiently sharp for use on most sewing projects.

While the invention has been particularly shown and described with reference to an embodiment thereof, it will be appreciated by those skilled in the art that various changes in form and detail may be made without departing from the spirit and scope of the invention.

I claim:

1. A threading needle comprising:

a rigid post having a first end that is pointed, a second end, and a first length; and a resiliently deformable closed loop member having a third end attached to the post proximate the first end, a fourth end, and a second length that is greater than the first length.

2. The threading needle as in claim 1 wherein the post has a first cross-section and the loop member has a second cross-section that is less than the first cross-section.

3. The threading needle as in claim 1 wherein the second end is not pointed.

4. A threading needle comprising:

a rigid post having a first end that is pointed and a second end; and a resiliently deformable closed loop member having a third end attached to the post proximate the first end and a fourth end that extends beyond the second end.

5. The threading needle as in claim 4 wherein the post has a first cross-section and the loop member has a second cross-section that is less than the first cross-section.

6. The threading needle as in claim 4 wherein the second end is not pointed.

7. A method of threading a needle comprising the steps of:

providing a rigid post having a first end that is pointed, a second end, and a first length;

providing a resiliently deformable closed loop member having a third end attached to the post proximate the first end, a fourth end, and a second length that is greater than the first length;

bending the loop member to a side of the post;

providing a thread and positioning the thread between the post and the loop member;

bending the loop member to another side of the post;

pulling the thread through the loop member; and returning the loop member to be generally flush with the post.

8. The method as in claim 7 wherein the post has a first cross-section and the loop member has a second cross-section that is less than the first cross-section.

9. The threading needle as in claim 7 wherein the second end is not pointed.

* * * * *